United States Patent [19]

Ellis et al.

[11] Patent Number: 4,582,510

[45] Date of Patent: Apr. 15, 1986

[54] STABILIZED DITHIONITE SOLUTIONS

[76] Inventors: Leonard C. Ellis, 2432 Taylorwood Blvd., Chesapeake, 23321; Edwin D. Little, 5630 Parish La., Portsmouth, both of Va. 23703

[21] Appl. No.: 664,851

[22] Filed: Oct. 25, 1984

[51] Int. Cl.[4] ..... C09B 67/00; A62D 3/00; C01B 15/00

[52] U.S. Cl. ..... 8/561; 8/592; 8/650; 8/110; 8/115.68; 8/918; 252/8.6; 252/188.23; 423/265; 423/515

[58] Field of Search ..... 8/561, 592, 650, 110, 8/115.68; 252/188.23

[56] References Cited

U.S. PATENT DOCUMENTS

| | | | |
|---|---|---|---|
| 3,804,944 | 4/1974 | Kise et al. | 252/188.22 |
| 3,985,674 | 10/1976 | Ellis et al. | 252/188.24 |
| 4,100,098 | 7/1978 | Magan | 252/186.25 |
| 4,534,954 | 8/1985 | Little et al. | 8/110 |

OTHER PUBLICATIONS

R. C. Shah, Textile Chemist and Colorist, 1972, vol. 4, No. 11, pp. 59–61.

G. P. Nair and R. C. Shah, Textile Chemist and Colorist, 1970, vol. 2, No. 13, pp. 239–244.

*Primary Examiner*—A. Lionel Clingman

*Attorney, Agent, or Firm*—Depaoli & O'Brien

[57] ABSTRACT

Guar and xanthan gums are used as additives to sodium dithionite aqueous solutions for enhancing the stability of such solutions when in contact with air and used for vat dyeing of textiles and bleaching. The gums are added at levels of 0.1–0.2% by wt. and preferably at 0.15% by wt. of the solution. The stability of these polymeric-containing bleaching solutions is enhanced by more than 100–200%.

6 Claims, No Drawings

STABILIZED DITHIONITE SOLUTIONS

BACKDGROUND OF THE INVENTION

1. Field of the Invention

This invention relates to dithionite solutions used in the bleaching and vat dyeing of textiles and especially relates to stabilizing sodium dithionite solutions. It particularly relates to enhancing the stability of sodium dithionite solutions during storage by adding selected suspending agents thereto.

2. Review of the Prior Art

Aqueous dissolved mixtures of sodium dithionite and sodium sulfite are employed in the bleaching of textiles, but these solutions are subject to decomposition during storage. To prevent extensive decomposition, it is customary to control the storage temperature and the pH of the solution.

The stability of sodium dithionite solutions in air has been tested by adding various preservatives, as reported in *Chimie et Industrie,* March 1932, pages 527–533, by A. Seyewetz and P. Kalmar. They found that the most effective preservatives for retaining the reducing power of sodium dithionite solutions at 3% concentration and at ordinary temperatures were the following alkaline substances or substances with subsequent alkaline reactions, listed in decreasing order of efficiency: tribasic sodium phosphate, sodium silicate, potassium carbonate, sodium carbonate, pyrogallic acid, ammonium sulfocyanide, ammonia, sodium sulfide, and methylamine. Several aldehydes were also found to be good stabilizers, but they formed compounds with sodium dithionite which lessened its reducing properties in the cold.

In an article by James N. Etters in *Textile Chemist and Colorist,* Vol. 4, No. 3 (March), 1972, pages 49–54, experiments were reported on various additives for enhancing the stabilization of sodium dithionite solutions. Among these, glucose-hydrosulfite was reported as a compound that was in use in the 30's but was of little interest in printing and which had questionable value for continuous pad-steam dyeing.

In *Textile Chemist and Colorist,* Vol. 4, No. 11 (November), 1972, pages 59–61, R.C. Shah commented that a large excess of sodium dithionite (approximately four times the theoretical quantity required for reducing the dye) was used in vat dyeing by batch methods in order to avoid oxidation of leuco vat dyes, leading to wastage of the material and sometimes creating problems during dyeing. He accordingly sought the partial substitution of hydrosulfite with other reducing agents during vat dyeing. Dextrin and glucose were tested. Alkaline solutions of dextrin and glucose, in presence or in absence of sodium bisulfite, did not generate enough potential, even at 95° C., to reduce vat dyes. However, the stability of a vat dye bath was increased by the addition of a mixture of dextrin and sodium bisulfite, the former increasing the stability of leuco vat dye and the latter retarding the rate of oxidation of excess dithionite present in the bath, so that the stability of the dye bath indicated the possibility of reducing the quantity of dithionite in the dye bath by about 50%. Adding glucose to the dye bath adversely affected the stability, but the adverse effect was minimized when a mixture of glucose and sodium bisulfite was used.

In U.S. Pat. No. 3,804,944 of Kise and Ellis, decomposition was avoided and various concentrations of certain dithionite solutions were effectively stabilized with caustic soda added at 1.4% to 20% by weight of the sodium dithionite present while minimizing air exposure with temperatures controlled to approximately 50° F.

In U.S. Pat. No. 3,985,674 of Ellis and Kise, sodium dithionite bleaching solutions for groundwood pulps were disclosed which required no additional chemicals for pH adjustment prior to direct application to the pulps. These solutions were based on both zinc-derived and formate-derived sodium dithionite and contained small percentages of at least four additives selected from the following group: a chelating agent, zinc dithionite, zinc sulfate, sodium carbonate, sodium hydroxide, sodium tripolyphosphate, sodium phosphate, and sodium metaborate.

Magan reported in U.S. Pat. No. 4,100,098 that aqueous solutions containing mixtures of sodium dithionite and sodium sulfite, having concentrations of greater than 13% by weight of sodium dithionite, were stabilized by adding potassium hydroxide in an amount which was sufficient to provide a residual of about 1–12 grams per liter of solution, so that these solutions could be stored at temperatures of 0–15° C. without crystallization taking place.

At the present time, a well run continuous dyeing operation normally operates with about a 10% excess of sodium dithionite in its Chem Pad formulas. Nevertheless, because of the unique conditions that prevail in a textile mill wherein a vat dye is exposed to air for protracted periods before dyeing and during padding, there is a need for a simple and readily controlled method of enhancing the stability of the sodium dithionite.

SUMMARY OF THE INVENTION

It is the object of this invention to enhance the stability of aqueous sodium dithionite solutions while exposed to the air under commercially operative conditions.

In accordance with this objective and the principles of this invention, it has surprisingly been discovered that adding selected suspension agents to the sodium dithionite solution enhances the stability thereof during use in textile vat dyeing and bleaching operations.

The stability of sodium dithionite solutions in contact with air has been tested by adding six thickening agents to an aqueous sodium dithionite solution at one addition level.

At the addition level of 0.15% by weight, it was specifically found that guar gum performed best and that xanthan gum was also excellent. Polyacrylamide produced insignificant stability enhancement, and sodium alginate produced none. Carboxymethyl cellulose and gelatin produced decidedly negative results.

It was initially theorized that a polymeric additive would act as a thickening agent and would serve to reduce oxygen diffusion into the solution, thereby imparting an increased solution stability above that realized through the addition of sodium hydroxide. However, the surprising differences that have been found among the six tested polymeric suspending agents indicates that the mechanism cannot be explained in such a simple manner. Other physico-chemical processes are evidently at work and remain to be investigated and explained.

DESCRIPTION OF THE PREFERRED EMBODIMENTS

The invention may be more completely understood by reference to the following examples in which six polymeric materials were screened as stabilizers for a textile bleaching solution, containing 13.5% $Na_2S_2O_4$ by weight, which was made up as follows:

| | |
|---|---|
| water | 3.2 liters |
| 50% NaOH | 101.4 grams |
| Kelate-100 | 6.0 ml |
| sodium dithionite (formate derived, 88% $Na_2S_2O_4$) | 600 grams |

All of the solutions were placed in a large Dewar flask containing a pH probe and a thermocouple, both being attached to a linear strip recorder. The solution, open to the air, was stirred with a magnetic bar and monitored continuously over a period of time to allow for the major portion of the sodium dithionite to decompose, as indicated by the pH and temperature of the solution. The observations were repeated with other solutions of this sodium dithionite, containing additives at the same 0.15 wt. % level. Results of these tests are listed for each example in the following table.

| Ex. No | Additive | Initial pH | Time to pH 7, hrs. | Initial Temp, °F. | Temp at pH 7, °F. |
|---|---|---|---|---|---|
| 1. | None | 12 | 11 | 45 | 82 |
| 2. | Guar | 12.5 | 39 | 47 | 85 |
| 3. | Xanthan | 13 | 25 | 41 | 73 |
| 4. | Polyacrylamide | 13 | 14 | 53 | 74 |
| 5. | Na Alginate | 13 | 11 | 44 | 80 |
| 6. | Carboxymethyl Cellulose | 13.7 | 6.5 | 44 | 60 |
| 7. | Gelatin | 13 | 7 | 53 | 75 |

The sodium dithionite solution may be at a concentration of 5–30% of sodium dithionite and is preferably at 10–15% sodium dithionite. All additives in the table were at 0.15% by weight of the sollution. The guar gum was sold under the trademark Jaquar 6003 by Celanese Corp. The Xanthan is an industrial grade gum sold under the trademark Kelzan by the Kelco Division, Merck and Co., Inc. The polyacrylamide was sold under the trademark Polyhall 7J by the Celanese Corp. The gelatin was grade 300 Bloom from Sigma Chemical Co. The Kelate-100 is the tetrasodium salt of ethylenediamine tetraacetic acid (EDTA-$Na_4$) sold by Dan River Inc.

These tests quite clearly show that the six polymeric materials had vastly different inhibitory effects upon oxidative attack by oxygen on the dithionite ion.

Guar increased the longevity of the dithionite solution by 218%, and the xanthan gum increased the longevity of the solution by 127%. These longevity increases are highly significant and of very considerable practical importance in the textile, pulp and paper and clay industries.

What is regarded as the invention and is desired to be protected is defined in the accompanying claims.

What is claimed is:

1. A sodium dithionite solution having enhanced stability when in contact with air, comprising guar gum as a polymeric additive.

2. The solution of claim 1, wherein said guar gum is present in said solution within the range of 0.1–0.2% by wt.

3. The solution of claim 2, wherein said guar gum is present in said solution at 0.15% by weight.

4. The process of protecting a sodium dithionite solution used in vat dyeing of textiles and bleaching, conprising the addition of guar gum as a stabilizer therefor.

5. The process of claim 4, wherein said guar gum is added at a level of 0.15% by wt.

6. The process of claim 5, wherein said solution is at an initial pH of 12–14 and an initial temperature of 40°–55° F.

* * * * *